US007509807B2

(12) United States Patent
Bruck et al.

(10) Patent No.: US 7,509,807 B2
(45) Date of Patent: Mar. 31, 2009

(54) CONCENTRIC CATALYTIC COMBUSTOR

(75) Inventors: Gerald Joseph Bruck, Oviedo, FL (US); Mary Anne Alvin, Pittsburgh, PA (US)

(73) Assignee: Siemens Energy, Inc., Orlando, FL (US)

( * ) Notice: Subject to any disclaimer, the term of this patent is extended or adjusted under 35 U.S.C. 154(b) by 869 days.

(21) Appl. No.: 10/918,275

(22) Filed: Aug. 13, 2004

(65) Prior Publication Data

US 2006/0032227 A1 Feb. 16, 2006

(51) Int. Cl.
*F02C 1/00* (2006.01)
*F02G 3/00* (2006.01)

(52) U.S. Cl. ..... 60/723; 60/39.822

(58) Field of Classification Search ..... 60/723, 60/777, 39.37, 804, 39.822
See application file for complete search history.

(56) References Cited

U.S. PATENT DOCUMENTS 3,657,883 A * 4/1972 De Corso ..... 60/39.37
4,162,993 A 7/1979 Retallick
4,265,085 A 5/1981 Fox et al.
4,350,617 A 9/1982 Retallick et al.
4,545,430 A 10/1985 Retallick
4,598,063 A 7/1986 Retallick
4,870,824 A 10/1989 Young et al.
5,202,303 A * 4/1993 Retallick et al. ..... 502/439
5,232,357 A * 8/1993 Dalla Betta et al. ..... 431/7
5,278,125 A * 1/1994 Iida et al. ..... 502/439
5,368,475 A 11/1994 Suppiah et al.
5,406,704 A 4/1995 Retallick
5,461,864 A * 10/1995 Betta et al. ..... 60/723
5,518,697 A * 5/1996 Dalla Betta et al. ..... 422/173
5,525,309 A 6/1996 Breuer et al.
5,729,967 A * 3/1998 Joos et al. ..... 60/39.6
5,865,864 A 2/1999 Bruck
5,946,917 A * 9/1999 Hums et al. ..... 60/723
6,060,173 A 5/2000 Retallick
6,098,396 A * 8/2000 Wen et al. ..... 60/777
6,116,014 A * 9/2000 Dalla Betta et al. ..... 60/777
6,158,222 A 12/2000 Retallick
6,174,159 B1 1/2001 Smith et al.
6,190,784 B1 2/2001 Maus et al.
6,217,832 B1 * 4/2001 Betta et al. ..... 422/179
6,286,300 B1 * 9/2001 Zelina et al. ..... 60/804
6,358,040 B1 3/2002 Pfefferle et al.
6,408,629 B1 * 6/2002 Harris et al. ..... 60/804
6,500,393 B2 12/2002 Nakamori et al.
6,619,043 B2 * 9/2003 Bruck et al. ..... 60/723
6,630,423 B2 10/2003 Alvin et al.
6,669,914 B1 * 12/2003 Wen et al. ..... 422/180
2002/0182551 A1 12/2002 Carroni et al.

* cited by examiner

*Primary Examiner*—William H Rodriguez

(57) ABSTRACT

A catalytic combustor (28) includes a plurality of concentric tubular pressure boundary elements (46). The pressure boundary elements are arranged to form a first annular space (e.g., 50) conducting a first fluid flow (e.g., 60) and a second annular space (e.g. 49), separate from the first annular space, conducting a second fluid flow (e.g., 58). A catalytic material (32) is disposed on a surface (e.g., 64) of at least one of the pressure boundary elements and exposed to at least one of the fluid flows.

13 Claims, 5 Drawing Sheets

CONCENTRIC CATALYTIC COMBUSTOR

FIELD OF THE INVENTION

This invention relates generally to gas turbine engines, and, in particular, to a catalytic combustor comprising concentric tubular pressure boundary elements.

BACKGROUND OF THE INVENTION

It is known to use catalytic combustion in gas turbine engines to reduce NOx emissions. One such catalytic combustion technique known as lean catalytic, lean burn (LCL) combustion, involves completely mixing fuel and air to form a lean fuel mixture that is passed over a catalytically active surface prior to introduction into a downstream combustion zone. However, the LCL technique requires precise control of fuel and air volumes and may require the use of a complex preburner to bring the fuel/air mixture to lightoff conditions. An alternative catalytic combustion technique is the rich catalytic, lean burn (RCL) combustion process that includes mixing fuel with a first portion of air to form a rich fuel mixture. The rich fuel mixture is passed over a catalytic surface and mixed with a second portion of air in a downstream combustion zone to complete the combustion process.

U.S. Pat. No. 6,174,159 describes an RCL method and apparatus for a gas turbine engine having a catalytic combustor using a backside cooled design. The catalytic combustor includes a plurality of catalytic modules comprising multiple cooling conduits, such as tubes, coated on an outside diameter with a catalytic material and supported in the catalytic combustor. A portion of a fuel/oxidant mixture is passed over the catalyst coated cooling conduits and is oxidized, while simultaneously, a portion of the fuel/oxidant enters the multiple cooling conduits and cools the catalyst. The exothermally catalyzed fluid then exits the catalytic combustion system and is mixed with the cooling fluid outside the system, creating a heated, combustible mixture.

To reduce the complexity and maintenance costs associated with catalytic modules used in catalytic combustors, simplified designs are needed.

BRIEF DESCRIPTION OF THE DRAWINGS

The invention will be more apparent from the following description in view of the drawings that show.

DETAILED DESCRIPTION OF THE INVENTION

Figure 1:
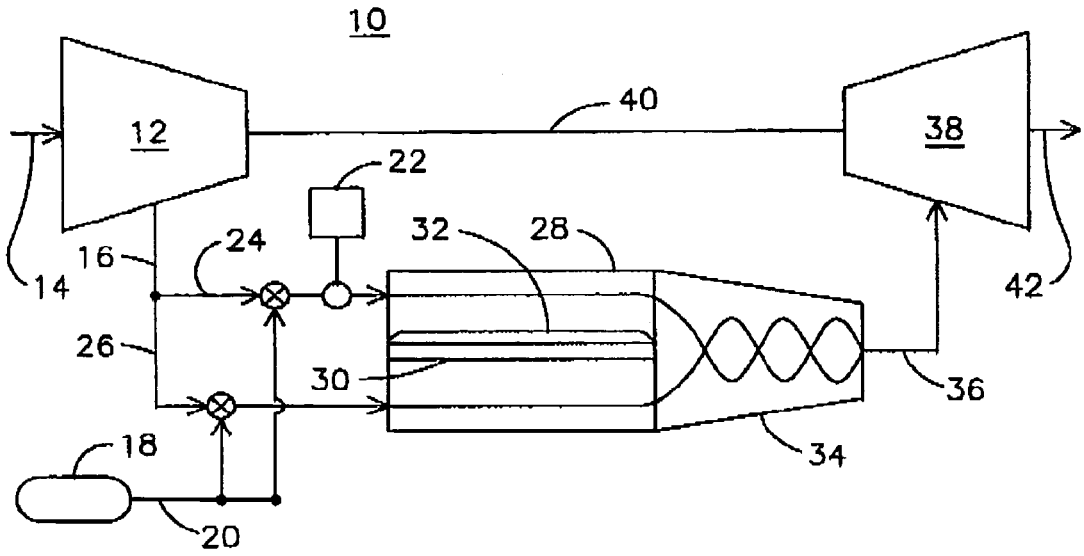
FIG. 1 is a functional diagram of a gas turbine engine including a catalytic combustor.

FIG. 1 illustrates a gas turbine engine 10 having a compressor 12 for receiving a flow of filtered ambient air 14 and for producing a flow of compressed air 16. The compressed air 16 is separated into a combustion mixture fluid flow 24 and a cooling fluid flow 26, respectively, for introduction into a catalytic combustor 28. The combustion mixture fluid flow 24 is mixed with a flow of a combustible fuel 20, such as natural gas or fuel oil for example, provided by a fuel source 18, prior to introduction into the catalytic combustor 28. The cooling fluid flow 26 may be introduced directly into the catalytic combustor 28 without mixing with a combustible fuel. Optionally, the cooling fluid flow 26 may be mixed with a flow of combustible fuel 20 before being directed into the catalytic combustor 28. A combustion mixture flow controller 22 may be used to control the amount of the combustion mixture fluid flow provided to the catalytic combustor 28 responsive to a gas turbine load condition.

Inside the catalytic combustor 28, the combustion mixture fluid flow 24 and the cooling fluid flow 26 are separated by a pressure boundary element 30. In an aspect of the invention, the pressure boundary element 30 is coated with a catalytic material 32 on the side exposed to the combustion mixture fluid flow 24. The catalytic material 32 may have as an active ingredient of precious metals, Group VIII noble metals, base metals, metal oxides, or any combination thereof. Elements such as zirconium, vanadium, chromium, manganese, copper, platinum, palladium, osmium, iridium, rhodium, cerium, lanthanum, other elements of the lanthanide series, cobalt, nickel, iron, and the like may be used.

In a backside cooling embodiment, the opposite side of the pressure boundary element 30 confines the cooling fluid flow 26. While exposed to the catalytic material 32, the combustion mixture fluid flow 24 is oxidized in an exothermic reaction, and the catalytic material 32 and the pressure boundary element 30 are cooled by the unreacted cooling fluid flow 26, thereby absorbing a portion of the heat produced by the exothermic reaction.

After the flows 24,26 exit the catalytic combustor 28, the flows 24,26 are mixed and combusted in a plenum, or combustion completion stage 34, to produce a hot combustion gas 36. The hot combustion gas 36 is received by a turbine 38, where it is expanded to extract mechanical shaft power. In one embodiment, a common shaft 40 interconnects the turbine 38 with the compressor 12 as well as an electrical generator (not shown) to provide mechanical power for compressing the ambient air 14 and for producing electrical power, respectively. The expanded combustion gas 42 may be exhausted directly to the atmosphere or it may be routed through additional heat recovery systems (not shown).

Figure 3:
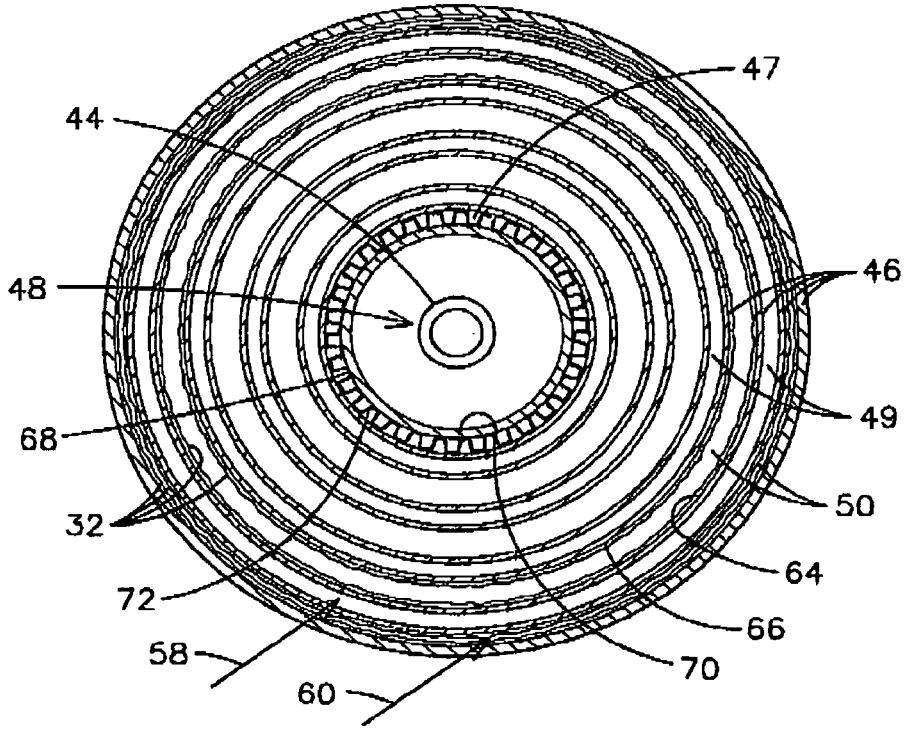
FIG. 3 is a cross sectional view of the concentric catalytic combustor of FIG. 2 as seen along plane 3-3 of FIG. 2.
Figure 2:
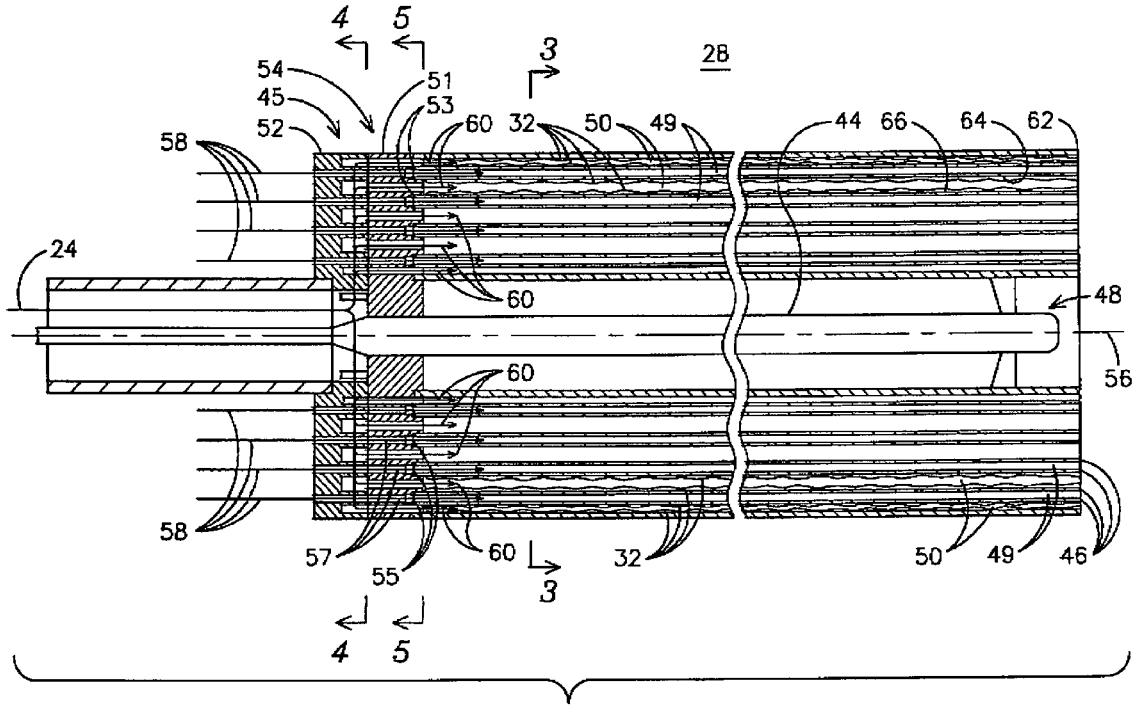
FIG. 2 illustrates an axial cross section of a concentric catalytic combustor taken along a direction of flow though the combustor.

FIG. 2 illustrates a cross section of an improved catalytic combustor 28 including a plurality of concentric tubular pressure boundary elements 46 arranged around a central core region 48. FIG. 3 is a cross sectional view of the catalytic combustor 28 of FIG. 2 as seen along plane 3-3 of FIG. 2, and shows the concentric arrangement of the tubular pressure boundary elements 46 around the central region 48 to form annular spaces, such as spaces 47, 49, 50, for conducting respective fluid flows therethrough. The improved catalytic combustor 28 includes at least one annular space for conducting a first fluid flow therethrough and a second annular space, separate from the first annular space, for conducting a second fluid flow therethrough. A catalytic material is disposed in at least one of the spaces and is exposed to the fluid flowing therethrough.

As used herein, the term "concentric" includes pressure boundary elements centered around the central region 48, not just about a central axis 56. Accordingly, the elements 46 may be offset from one another so that the annular region formed therebetween may not be a symmetrical annular region. The term "tubular" is meant to include an element defining a flow channel having a circular, rectangular, hexagonal or other geometric cross section. "Annular space" is meant to refer to a peripheral space defined between a first tubular element and a second tubular element disposed around and spaced away from the first tubular element, such as a tubular element having a circular cross section (e.g., a cylindrical element), concentrically disposed around another cylindrical element to form a peripheral space therebetween.

The combustor 28 may include a manifold assembly 45 attached to an upstream end 54 of the combustor 28 for retaining the pressure boundary elements 46 and receiving and directing fluid flows into the annular spaces 49, 50 between the elements 46. The annular spaces 49, 50 may extend from the manifold assembly 45 to a combustor exit 62. The manifold assembly 45 may include a one-piece assembly, or, in an embodiment, may include a two-piece assembly comprising a manifold 52 and an adapter 51. In another embodiment, a pilot burner 44 may be disposed in the central region 48 to provide a pilot flame for stabilizing flames in the combustion completion stage 34 under various engine loading conditions.

In an aspect of the invention, a first set of spaces 49 may be configured to conduct respective portions 58 of the cooling fluid flow 26, and a second set of spaces 50 may be configured to conduct respective portions 60 of the combustion mixture fluid flow 24. As shown in FIG. 3, the spaces 50 conducting respective portions 60 of the combustion mixture fluid flow 24 may include a catalytic material 32 disposed on a surface of at least one of the pressure boundary elements 46 defining the space 50 and exposed to the portion 60 of the combustion mixture fluid flow 24 flowing in the space 50, thereby forming a catalytically active space. For example, an inner diameter surface 64 of one of the pressure boundary elements 46 forming an annular space 50 may include a catalytic material 32. In another embodiment, an outer diameter surface 66 of one of the pressure boundary elements 46 forming an annular space 50 may include a catalytic material 32. In yet another embodiment, an outer diameter surface 66 of a first boundary element and an inner diameter surface 64 of another pressure boundary element concentrically disposed around the first pressure boundary element may include a catalytic material 32 exposed to a portion 60 of the combustion mixture flow flowing in the space 50 defined by the first and second pressure boundary elements.

In another embodiment, the pressure boundary elements 46 may be configured to form a first set of annular spaces 49 comprising no catalytic material and conducting respective portions 58 of the cooling fluid flow 26 concentrically alternating with a second set of annular spaces 50 including a catalytic material 32 and conducting respective portions 60 of the combustion mixture fluid flow 24. A space 49 having no catalytic material disposed on surfaces defining the space 49 remains catalytically inactive and may conduct a portion of the cooling fluid flow 26 to define a cooling space used to backside cool adjacent catalytically active spaces. Accordingly, the catalytic combustor 28 may comprise a series of concentric tubular pressure boundary elements 46 defining an alternating arrangement of catalytically active annular spaces interspersed by annular cooling spaces. In another aspect of the invention, a pressure boundary element 68 surrounding the central region 48 may include a catalytic material 32 on its inner diameter surface 70 to form a catalytically active channel, or may not include a catalytic material to allow the region to be used as a cooling space.

To provide improved structural rigidity between the pressure boundary elements 46, a support structure 72, may be radially disposed between concentrically adjacent pressure boundary elements 46 within an annular space, such as space 47, defined between elements 46. The support structure 72 radially retains the adjacent pressure boundary elements 46 in a spaced configuration. For example, the support structure 72 may include a corrugated element brazed or welded to one or both of the pressure boundary elements 46 and may extend along an axial length of the combustor 28. In other embodiments, the support structure may include fins or tubular elements disposed in a space 47 between two adjacent elements 46. In an aspect of the invention, the support structure may be disposed in cooling spaces and/or catalytically active spaces. In another aspect, the support structure 72 itself may include a catalytic surface.

Figure 4:
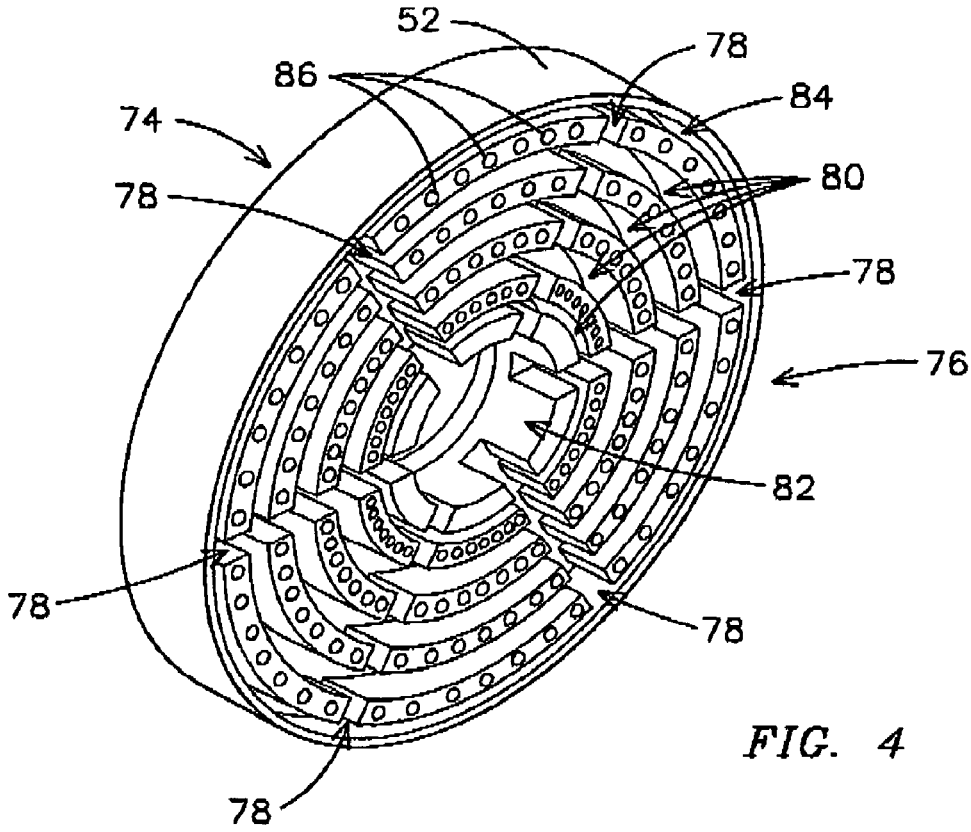
FIG. 4 is a perspective view of a manifold assembly of the concentric catalytic combustor of FIG. 2 as seen along plane 4-4 of FIG. 2.

FIG. 4 is a perspective view of the manifold assembly 45 of the concentric catalytic combustor 28 as seen along plane 4-4 of FIG. 2. Generally, the manifold assembly 45 is configured to receive the combustion mixture fluid flow 24 and the cooling fluid flow 26 on an inlet side 74 and to distribute the flows 24, 26 to the appropriate spaces between the pressure boundary elements 46 attached, such as by brazing, to an outlet side 76 of the manifold assembly 45. For example, respective portions 60 of the combustion mixture fluid flow 24 are delivered to catalytically active spaces and respective portions 58 of the cooling fluid flow 26 are delivered to cooling spaces. In an embodiment, the manifold assembly 45 includes a plurality of angularly spaced apart radial passageways 78 for receiving the combustion mixture fluid flow 24 and conducting portions 60 of the combustion mixture fluid flow 24 into annular spaces 80 formed in the manifold assembly 45 in fluid communication with catalytically active spaces of the concentric catalytic combustor 28. The combustion mixture fluid flow 24 may be introduced at a central opening 82 of the manifold assembly 52 and/or at an inlet (not shown) in fluid communication with a peripheral annular passageway 84. The manifold assembly 52 may also include axial passageways 86 interspersed among and isolated from the radial passageways 78 and the annular spaces 80. The axial passageways 86 receive the respective portions 58 of the cooling fluid flow 26 and conduct the portions 58 into cooling spaces of the concentric catalytic combustor 28. In another embodiment, the radial passageways 78 and the annular spaces 80 may be configured to receive and distribute the cooling fluid flow 26, and the axial passageways 86 may be configured to receive and distribute the combustion mixture fluid flow 24.

Figure 5:
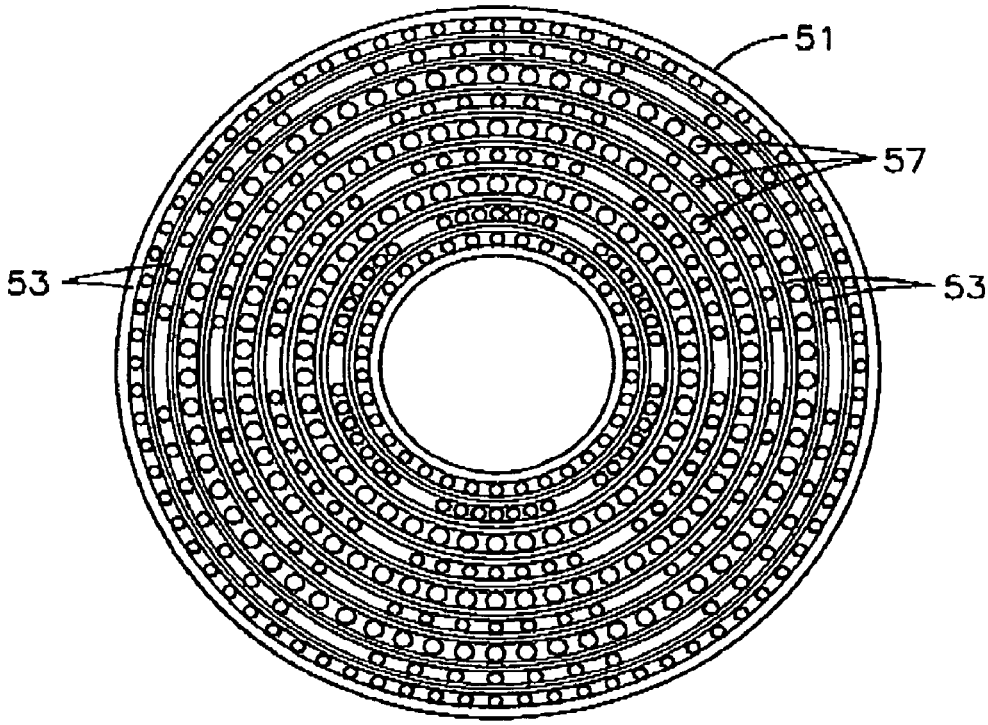
FIG. 5 is an end view of a manifold assembly of the concentric catalytic combustor of FIG. 2 as seen along plane 6-6 of FIG. 2.

As shown in FIGS. 2 and 5, the manifold assembly 52 may include a manifold 52 and an adapter 51 attached to a downstream side 76 of the manifold 52 to connect the pressure boundary elements 46 to the manifold 52 and conduct the portions 58, 60 of the fluid flows 24, 26 from the manifold 52 into the appropriate spaces 49, 50. The adapter 51 may include annular recesses 53 adapted for receiving the upstream ends 55 of the respective pressure boundary elements 46. The upstream ends 55 of the pressure boundary elements 46 may be mechanically attached to the adapter 51, for example, by press fitting, brazing, or welding. The adapter 51 includes passageways 57 extending upstream from the recesses 53 through the adapter 51 to allow fluid communication between the respective annular spaces 80 and the axial passageways 86 and the spaces 49, 50 between the pressure boundary elements 46 installed into the recesses 53. The adapter 51 may be welded or brazed to the downstream side 76 of the manifold 52 so that the manifold assembly 45 may be formed in two pieces to reduce a machining complexity required to manufacture the assembly 45.

In another aspect of the invention, staging of the combustible mixture fluid flow 24 to the catalytic combustor 28 may be accomplished by configuring the combustion mixture flow controller 22 to control the combustible mixture fluid flow 24 to a plurality of catalytically active spaces independently of other catalytically active spaces. For example, the combustion mixture flow controller 22 may be configured to control the combustion mixture flow responsive to a turbine load condition so that under partial loading, only a portion of the catalytically active spaces are fueled, and under full loading of the gas turbine, all of the catalytically active spaces are fueled.

Figure 6:
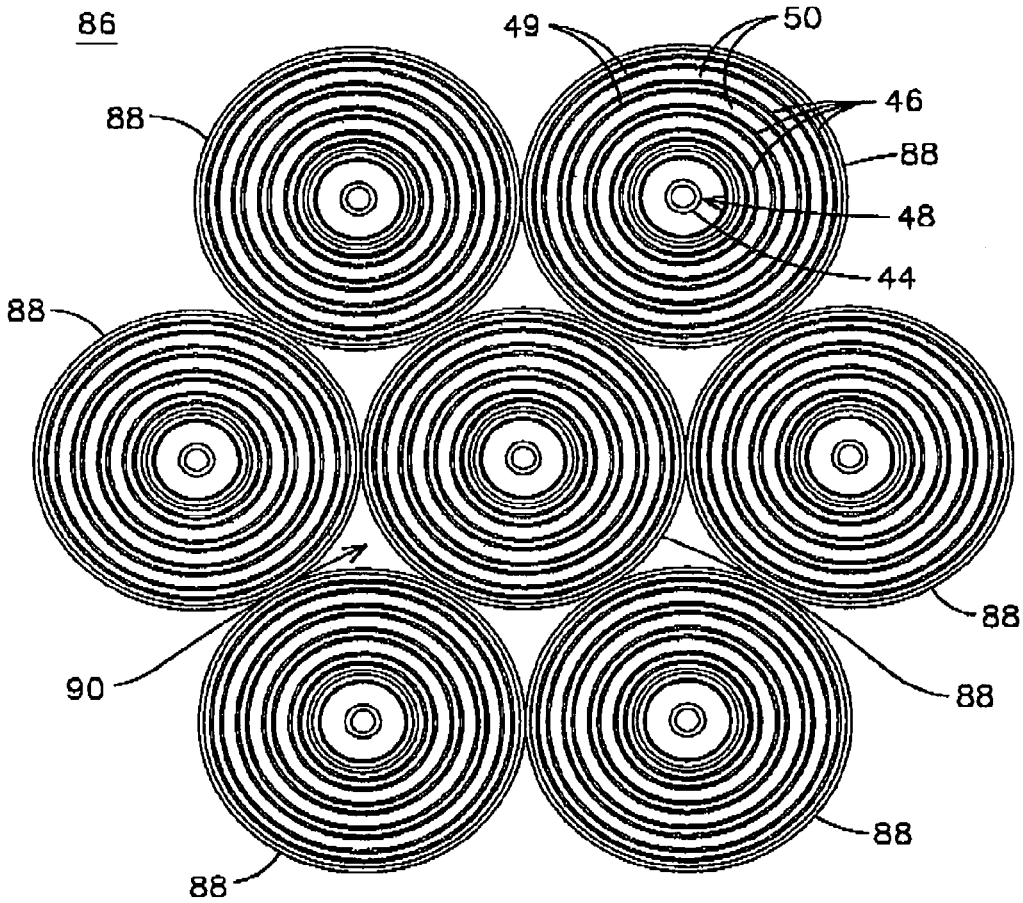
FIG. 6 is a cross sectional view of a catalytic combustor comprising a plurality of concentric catalytic combustor modules arranged around a central region.
Figure 7:
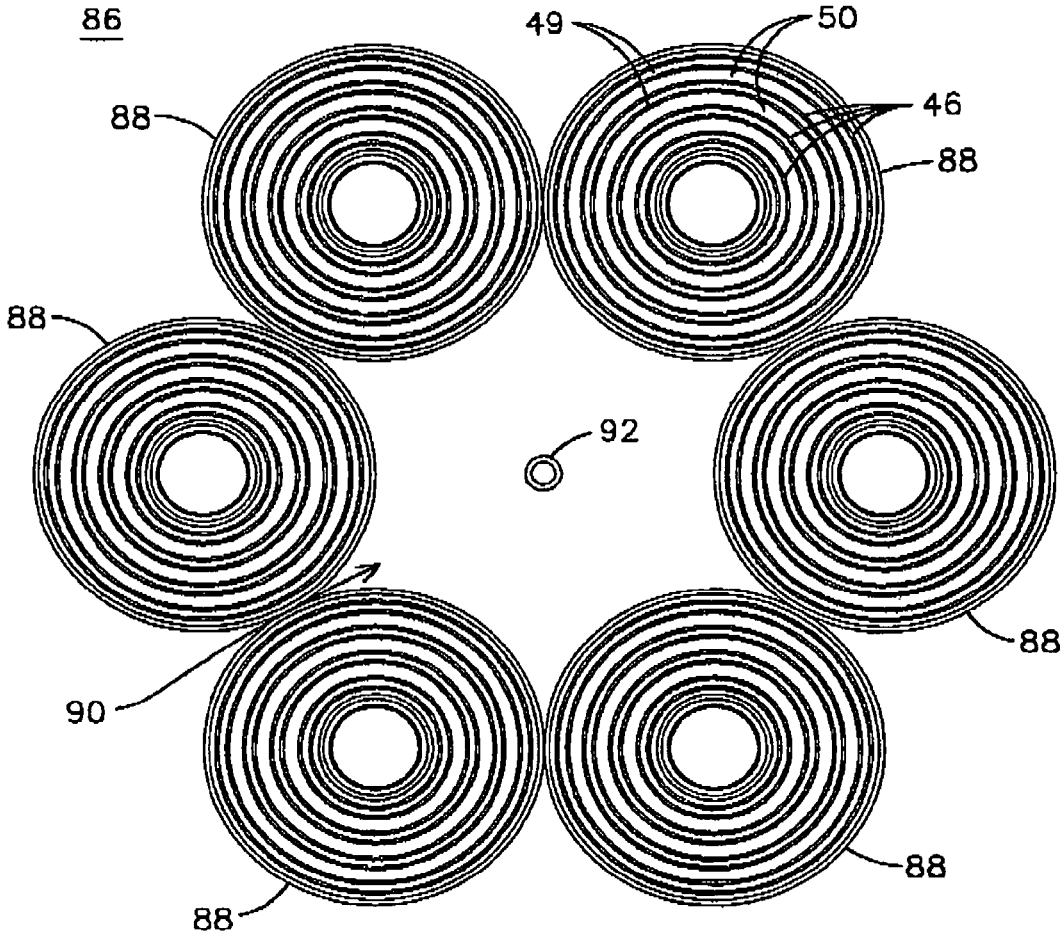
FIG. 7 is a cross sectional view of a catalytic combustor comprising a plurality of concentric catalytic combustor modules arranged around a central region including a pilot.

In an embodiment depicted in the cross sectional view of FIG. 6, a plurality of concentric catalytic combustion modules 88 (each module having a concentric configuration as described above) may be disposed around a central region 90 to form a catalytic combustor 86. Each module 88 may include a plurality of concentric tubular pressure boundary elements 46 forming annular spaces 50 therebetween. A first set of spaces 49 of each module 88 may conduct a cooling fluid flow and a second set of spaces 50 may conduct a combustible mixture fluid flow. A catalytic surface disposed in the annular spaces 50 conducting a combustible mixture flow (such as on an inner diameter and/or outer diameter surface of the pressure boundary elements defining the spaces 50, as described previously) is exposed to the combustible mixture fluid flow, thereby forming a catalytically active space. Spaces 49 conducting the cooling fluid define cooling spaces providing backside cooling for the catalytically active spaces. For example, catalytically active spaces may be alternated with cooling spaces in each of the catalytic combustion modules to provide a backside cooled, concentric catalytic combustion module 88. Each catalytic module 88 may include a manifold (not shown) attached to an upstream end of the module 88 for directing the combustion mixture flow into catalytically active spaces and the cooling flow into the cooling spaces. In an aspect of the invention, a catalytic combustion module 88 may be disposed in the central region 90. In yet another aspect, a pilot burner 44 may be disposed in a central region 48 of one or more of the catalytic combustion modules 88 forming the catalytic combustor 86. In aspect of the invention shown in FIG. 7, a pilot burner 92 may be disposed in the central region 90.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A catalytic combustor comprising:

a plurality of concentric tubular pressure boundary elements forming a first annular space conducting a first fluid flow and a second annular space separate from the first annular space conducting a second fluid flow; wherein the first fluid flow comprises a combustible fluid and the second fluid flow comprises a cooling fluid containing no combustible fuel; and a catalytic material disposed on a surface of at least one of the pressure boundary elements and exposed to at least one of the fluid flows.

2. The catalytic combustor of claim 1, wherein the surface comprises an inner diameter surface of the pressure boundary element.

3. The catalytic combustor of claim 1, wherein the surface comprises an outer diameter surface of the pressure boundary element.

4. The catalytic combustor of claim 1, wherein the surface comprises an outer diameter surface of a first pressure boundary element and an inner diameter surface of a second pressure boundary element concentrically disposed around the first pressure boundary element.

5. A catalytic combustor comprising:

a plurality of concentric tubular pressure boundary elements forming a first annular space conducting a first fluid flow and a second annular space separate from the first annular space conducting a second fluid flow, wherein the first fluid flow comprises a combustible fluid and the second fluid flow comprises a cooling fluid containing no combustible fuel; and a catalytic material disposed on a surface of at least one of the pressure boundary elements and exposed to at least one of the fluid flows;

the catalytic combustor, further comprising a support structure radially disposed between a first pressure boundary element and a second pressure boundary element disposed concentrically around the first pressure boundary element and within the second annular space, the support structure radially retaining the first and second first pressure boundary elements in a spaced configuration.

6. A catalytic combustor comprising:

a plurality of concentric tubular pressure boundary elements forming a first annular space conducting a first fluid flow and a second annular space separate from the first annular space conducting a second fluid flow; and a catalytic material disposed on a surface of at least one of the pressure boundary elements and exposed to at least one of the fluid flows;

wherein the pressure boundary elements are configured to form a plurality of first annular spaces defined by a surface comprising a catalytic material concentrically alternating with a plurality of second annular spaces defined by surfaces comprising no catalytic material.

7. The catalytic combustor of claim 6, further comprising a combustible fluid flow controller for independently controlling a combustible fluid flow to at least one of the plurality of first annular spaces independently of other first annular spaces.

8. A catalytic combustor comprising:

a plurality of concentric tubular pressure boundary elements forming a first annular space conducting a first fluid flow and a second annular space separate from the first annular space conducting a second fluid flow; and a catalytic material disposed on a surface of at least one of the pressure boundary elements and exposed to at least one of the fluid flows;

the catalytic combustor further comprising a pilot burner disposed within a radially innermost pressure boundary element.

9. A catalytic combustor comprising:

a plurality of concentric tubular pressure boundary elements forming a first annular space conducting a first fluid flow and a second annular space separate from the first annular space conducting a second fluid flow; and a catalytic material disposed on a surface of at least one of the pressure boundary elements anti exposed to at least one of the fluid flows;

the catalytic combustor further comprising a manifold assembly attached to an upstream end of the combustor, the manifold assembly comprising a radial passageway receiving the first fluid flow and conducting the first fluid flow into annular spaces formed in the manifold assembly in fluid communication with respective annular spaces formed by the plurality of concentric tubular pressure boundary elements.

10. The catalytic combustor of claim 9, the manifold assembly comprising a central opening receiving the first fluid flow and conducting the first fluid flow into the radial passageway.

11. The catalytic combustor of claim 10, the manifold assembly comprising an axial passageway remote from the radial passageways receiving the second fluid flow and conducting the second fluid flow into the second annular space.

12. A catalytic combustor comprising:

a plurality of catalytic combustion modules, each module comprising a plurality of concentric tubular pressure boundary elements forming a first annular space conducting a first fluid flow and a second annular space separate from the first annular space and conducting a second fluid flow and a catalytic surface disposed in at least one of the annular spaces and exposed to the flow conducted therethrough;

one of the plurality of the modules disposed along a central axis of the combustor;

remaining ones of the plurality of modules circumferentially disposed about the central axis radially outward of the one of the plurality of modules; and each module comprising a pilot burner disposed in a central region of the respective module.

13. A catalytic combustor comprising:

a plurality of catalytic combustion modules, each module comprising a plurality of concentric tubular pressure boundary elements forming a first annular space conducting a first fluid flow and a second annular space separate from the first annular space conducting a second fluid flow and a catalytic surface disposed in at least one of the annular spaces and exposed to flow conducted therethrough; and each module clrcumferentially disposed about a central axis radially outward of a central region of the combustor;

the catalytic combustor further comprising a pilot burner disposed in the central region.

* * * * *